US007676861B2

(12) United States Patent
Ward et al.

(10) Patent No.: US 7,676,861 B2
(45) Date of Patent: Mar. 16, 2010

(54) STRETCHER

(75) Inventors: Philip Ward, Cleckheaton (GB); David Wyman, Cleckheaton (GB)

(73) Assignee: Ferno (UK) Limited, West Yorkshire (GB)

( * ) Notice: Subject to any disclaimer, the term of this patent is extended or adjusted under 35 U.S.C. 154(b) by 484 days.

(21) Appl. No.: 11/474,602

(22) Filed: Jun. 26, 2006

(65) Prior Publication Data

US 2007/0000056 A1 Jan. 4, 2007

(30) Foreign Application Priority Data

Jun. 29, 2005 (GB) ..... 0513227.9

(51) Int. Cl.
*A47C 21/08* (2006.01)
*A61G 7/015* (2006.01)

(52) U.S. Cl. ..... 5/428; 5/430; 5/613

(58) Field of Classification Search ..... 5/428, 5/430, 425, 429, 621, 611, 613, 600, 620
See application file for complete search history.

(56) References Cited

U.S. PATENT DOCUMENTS

| | | | | |
|---|---|---|---|---|
| 2,786,214 | A * | 3/1957 | Armstrong | 5/430 |
| 4,409,695 | A | 10/1983 | Johnston et al. | |
| 4,794,656 | A | 1/1989 | Henley, Jr. | |
| 5,083,332 | A | 1/1992 | Foster et al. | |
| 5,092,722 | A | 3/1992 | Reazer, III et al. | |
| 5,179,744 | A | 1/1993 | Foster et al. | |
| 5,187,824 | A | 2/1993 | Stryker | |
| 5,394,580 | A | 3/1995 | Foster et al. | |
| 5,435,027 | A | 7/1995 | Bourgraf et al. | |
| 6,357,065 | B1 | 3/2002 | Adams | |
| 6,978,501 | B2 | 12/2005 | Vrzalik | |
| 7,406,729 | B2 * | 8/2008 | Hornbach et al. | 5/613 |
| 7,426,760 | B2 * | 9/2008 | Vrzalik | 5/618 |
| 2003/0159216 | A1 | 8/2003 | Tomeany et al. | |
| 2006/0059624 | A1 | 3/2006 | Poulos et al. | |
| 2006/0195984 | A1 * | 9/2006 | HakamiuN et al. | 5/430 |

FOREIGN PATENT DOCUMENTS

| | | |
|---|---|---|
| EP | 0 403 073 A2 | 12/1990 |
| EP | 0979641 A2 | 2/2000 |
| EP | 1 621 171 | 2/2006 |
| EP | 1 621 171 A | 2/2006 |
| EP | 1 666 013 A1 | 6/2006 |
| GB | 2348359 A1 | 4/2000 |
| WO | 9219466 | 11/1992 |
| WO | 2004060257 | 7/2004 |
| WO | WO 2004060257 A | 7/2004 |

OTHER PUBLICATIONS

European Patent Search Report dated Jul. 11, 2006.

* cited by examiner

*Primary Examiner*—Alexander Grosz
(74) *Attorney, Agent, or Firm*—Dinsmore & Shohl LLP

(57) ABSTRACT

The present invention relates to a stretcher which includes cot sides 160 and 162. These can be moved towards or away from the patient support to accommodate patients of greater width than average. The stretcher also includes a leg support that can be moved to a shock position by a hydraulic cylinder 152 connected to the lower end of the unshaped frame 150 at one end and at the other to the leg part of the patients support.

16 Claims, 14 Drawing Sheets

STRETCHER

The present application relates to stretchers that are sometimes known as cots, and to methods of using stretchers.

In recent years the weight of patients has been increasing. Patients over a certain size will not fit on conventional stretchers because they are wider than the upright sides of the cot. Either the sides can be lowered, in which case the patient risks falling off or rolling off the stretcher or an oversize stretcher can be provided. This is either dangerous or expensive or impracticable as ambulances cannot carry a spare stretcher just in case they encounter an overweight person.

In addition it is sometimes necessary to raise a part of the stretcher to raise the patients legs to put the patient in the shock position. This sudden manual operation can harm an operative, particularly if they do not have time to adjust their stance to the correct one for lifting the leg end or if the operative is working in a confined space such as an ambulance that may not permit the correct stance. The problem is particularly acute with overweight patients.

It is an object of the present invention to attempt to overcome at least one of the above or other problems.

According to one aspect of the present invention, stretcher apparatus includes a patient support and a pair of cot sides extending to an elevation greater than the support, each of the cot sides extending at least partially along a different side of the support, each of the cot sides being moveable from a first position to a second position in which, in the second position, each of the cot sides is further from a longitudinal center line of the stretcher than the distance from the center line when in the first position, each of the cot sides having a rail connected thereto and constrained to move therewith from the first position to the second position, the rail of each cot side being supported to a different side of a bracket via a respective guide and arranged to extend at least partially under the patient support when in the first position, and being coextensive over at least partially under the patient support when in the first position, and being coextensive over at least part of their extent in at least one position of the cot side.

Each of the cot sides may be slidably mounted.

Each of the cot sides may be releasably held in at least one, two or three different positions from the longitudinal center line.

At least one of the positions in which each of the cot sides can be releasably held may be the first or second position.

Each of the cot sides may be slideably moveable from the first position in to the second position.

In a second configuration, each of the cot sides may be at the same elevation or lower than the top of the patient support. Each of the cot sides may be moveable from the first configuration to the second configuration by pivotal movement. In the second configuration, each of the cot sides may provide an upwardly facing support. In the second position, each of the cot sides may be spaced from the patient support.

Each of the sides may have any of the features or limitations of the other cot side.

The predetermined factor may be the width or the weight of a patient. Each of the cot sides may be moved away from the center line prior to loading the patient.

The invention includes a method of using stretcher apparatus when the stretcher apparatus is as defined in the specification, including the claims.

According to another aspect of the present invention, stretcher apparatus includes a frame providing a patient support region, the apparatus further including a first and a second end region, one region being arranged to support the head of a patient and the other being arranged to support the legs of a patient, in which at least a first one of those regions is arranged to be moved from a first angle to a second, different angle relative to a frame of the stretcher, such movement being arranged to be effected by an extendable and contractable moving arrangement having a first part connected to the first region and a second part connected to a downwards projection from the frame.

The moving arrangement may be pivotally connected at one end to the downwards projection and at the other end to the first region.

The angle that the first region moves through when moving from the first to the second angle may be greater than the angle that the moving arrangement moves through such as by greater by more than 30 or 20 or 15 or 10 or 5 or 2 times.

The moving arrangement may be arranged to move through less than 30 or less than 20 or less than 10 or less than 5° when moving the first end region from the first to the second angle.

The frame may be movable relative to a lower portion of the stretcher between a raised position and a lower position in which the frame is closer to the lower portion.

The lower portion may include a frame and the downwards projection may be arranged to extend to the region of the frame of the lower portion when in the lower position. The downwards projection may extend beneath the extent of the frame of the lower portion. The frame of the lower portion may define an enclosure and the downwards projection may extend within the enclosure when in the lower position. Power means may be arranged to cause movement of the first region from the first angle to the second angle. The first end region may comprise the support for the legs. The second region may include any of the features of the first The present invention is defined in the claims appended hereto.

The present invention can be carried into practice in various ways but one embodiment will now be described by way of example and with reference to the accompanying drawings, in which.

Figure 14A:
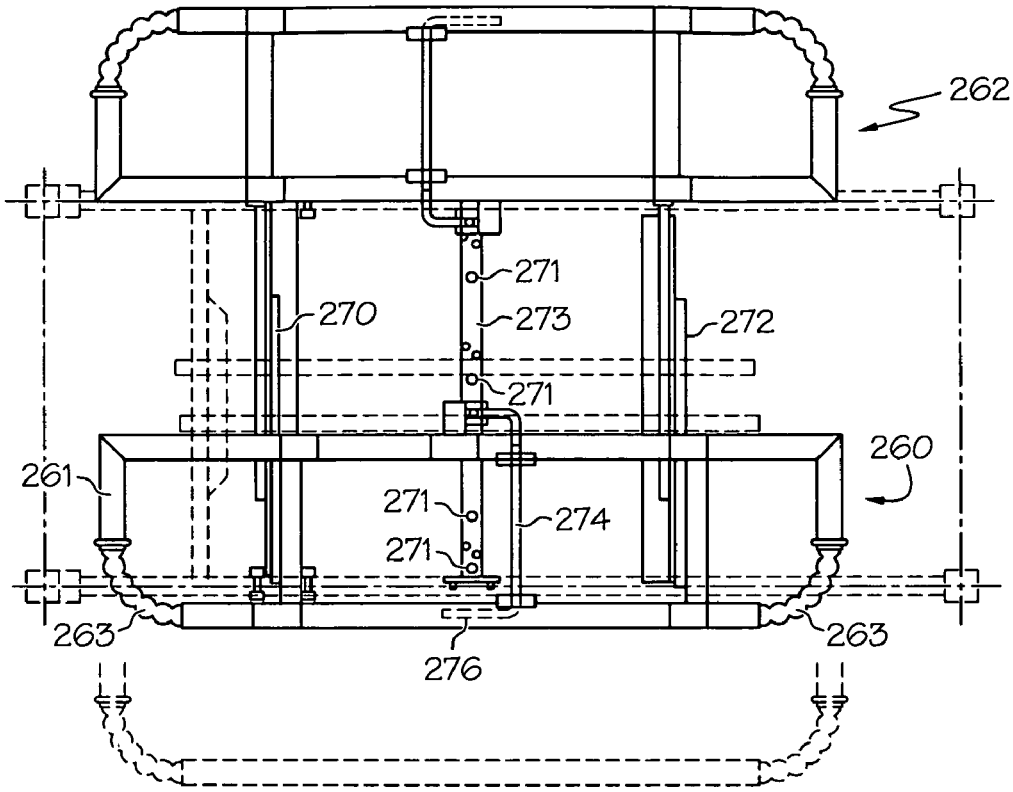
FIG. 14A is a plan view of an alternative embodiment in which the cot sides can be moved in and out with the cot sides being in the extended position.
Figure 14B:
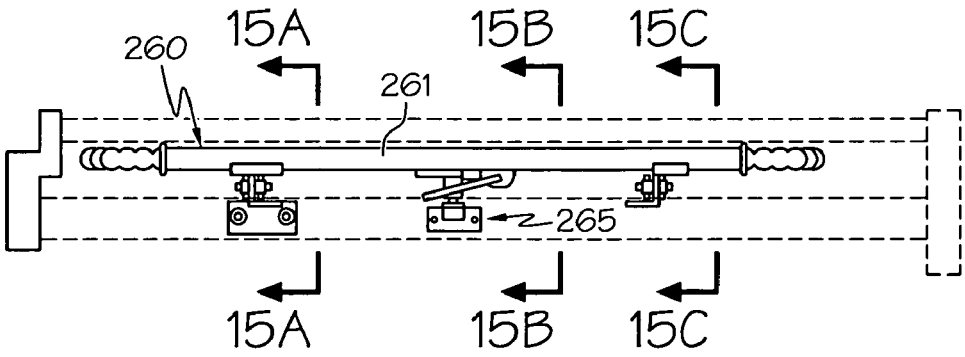
FIG. 14B is a side view of FIG. 14A.
Figure 15A:
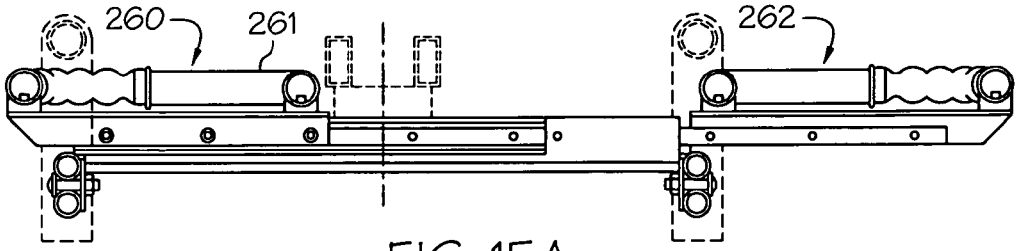
Figure 15B:
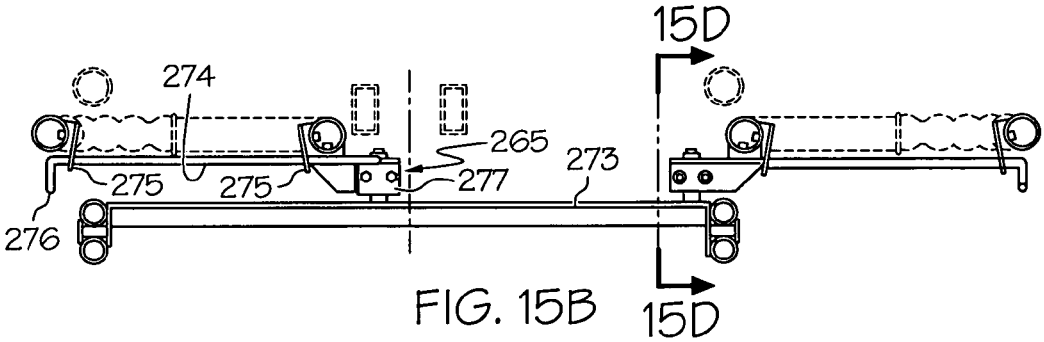
Figure 15C:
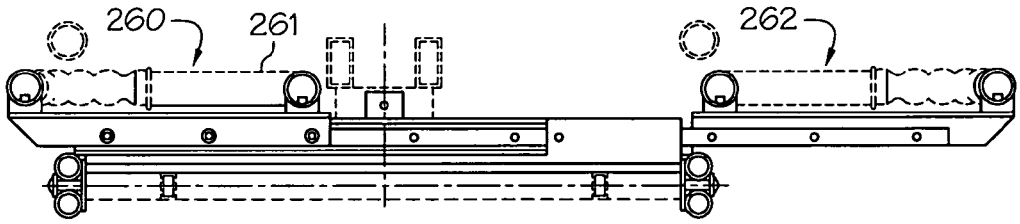
Figure 15D:
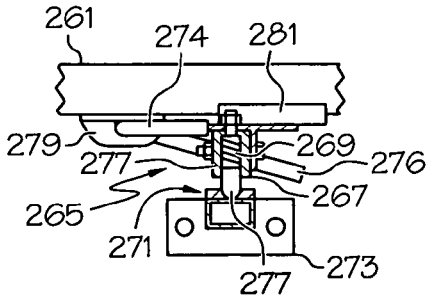

FIGS. 15A, B and C are sectional views along the lines A-A, B-B and C-C of FIG. 14B;

FIG. 15D is a sectional view along the line D-D and of FIG. 15B; and

Figure 16:
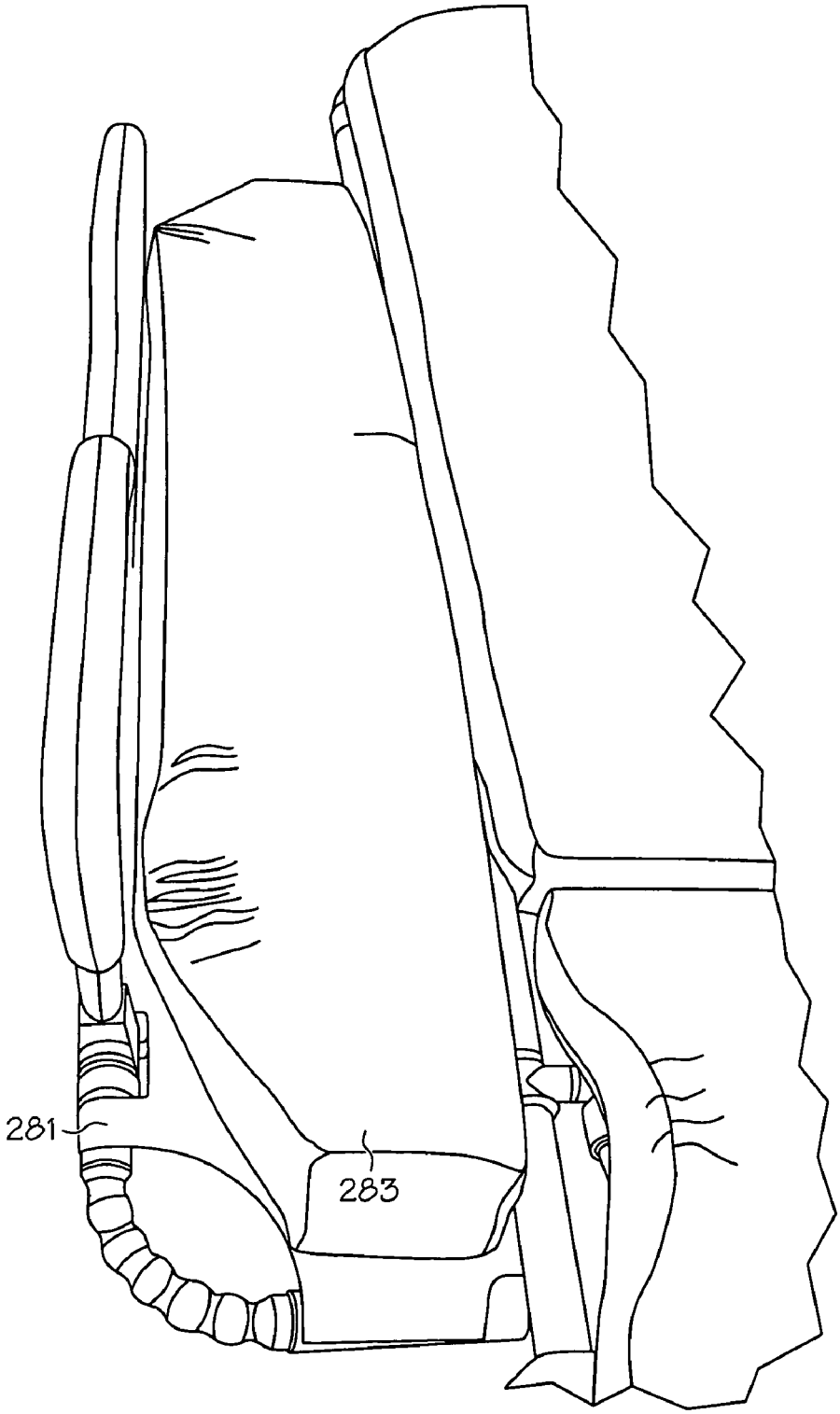

FIG. 16 is a perspective view from one end of one side of the stretcher with the cot side in the extended position.

Figure 1:
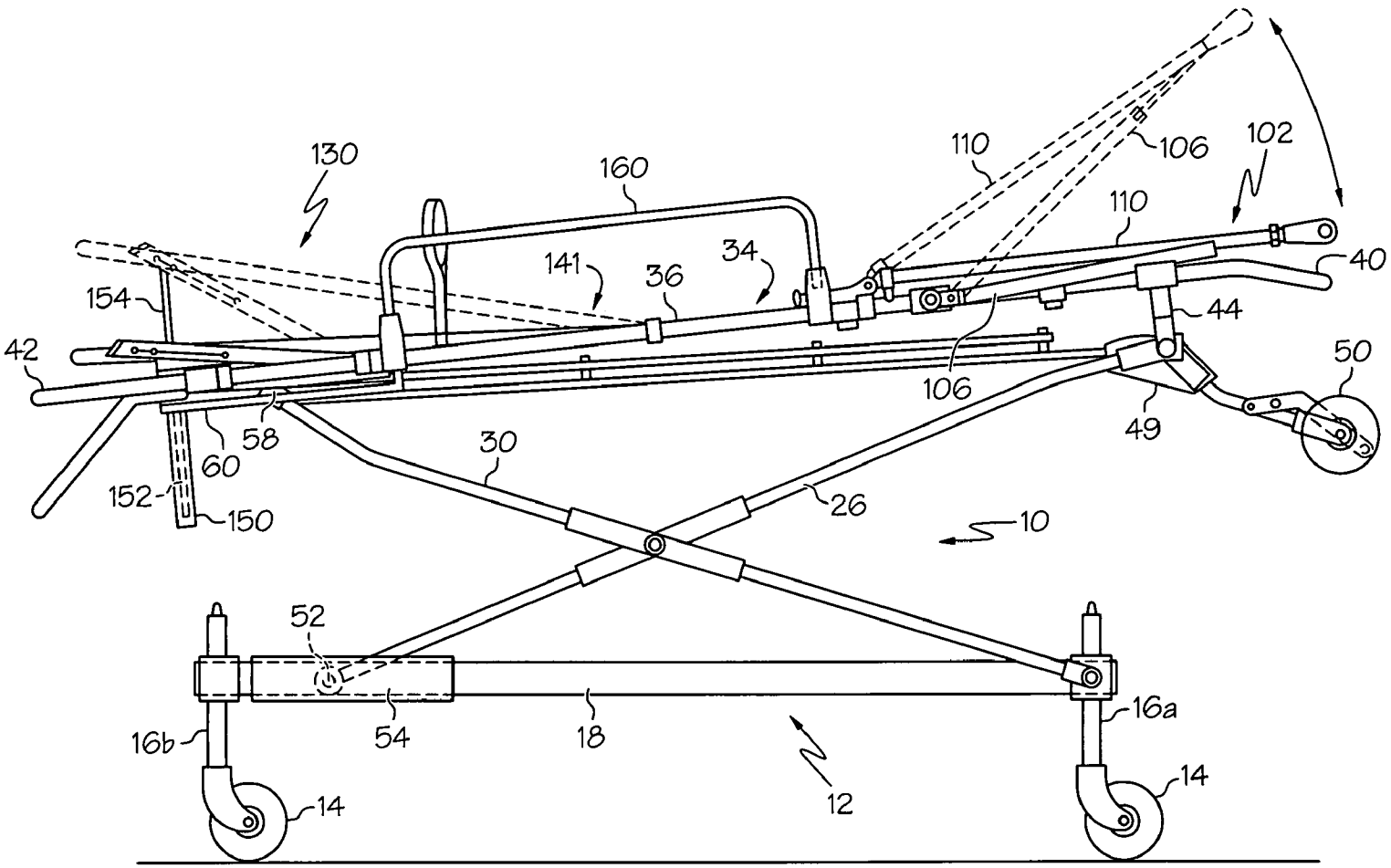
FIG. 1 is a side elevational view of a prior art roll-in stretcher cot with certain parts in broken lines for purposes of illustration.
Figure 2:
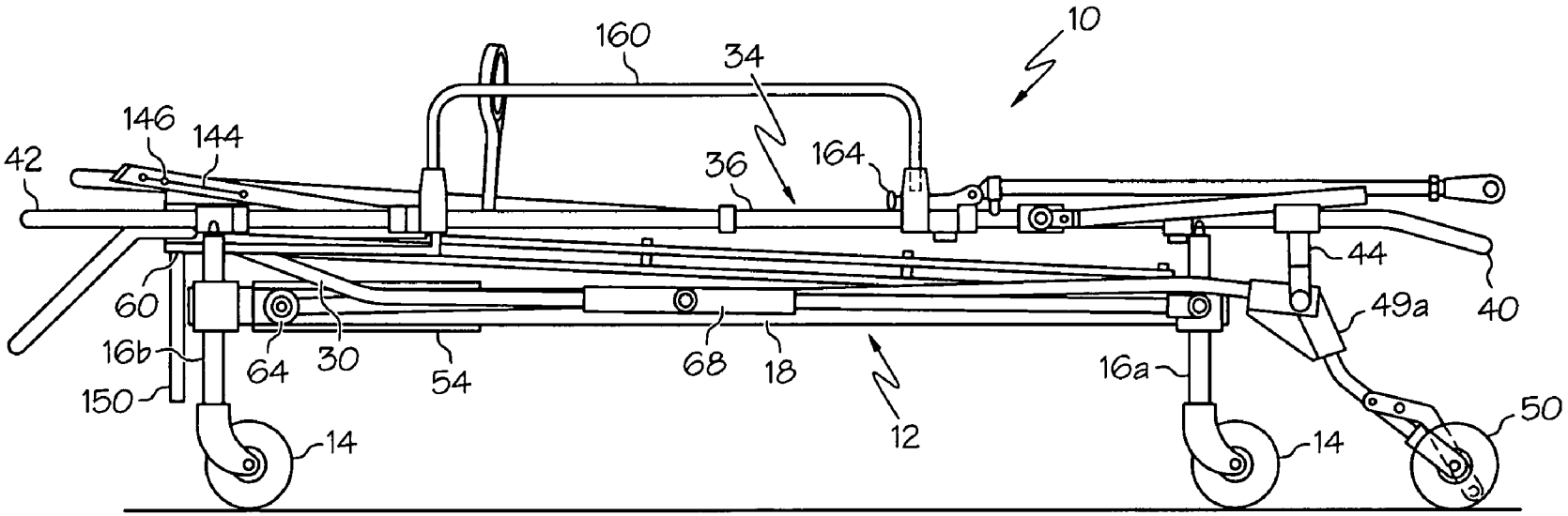
FIG. 2 is side elevational view of a prior art stretcher in a fully lowered configuration, with loading wheels on the ground.
Figure 9:
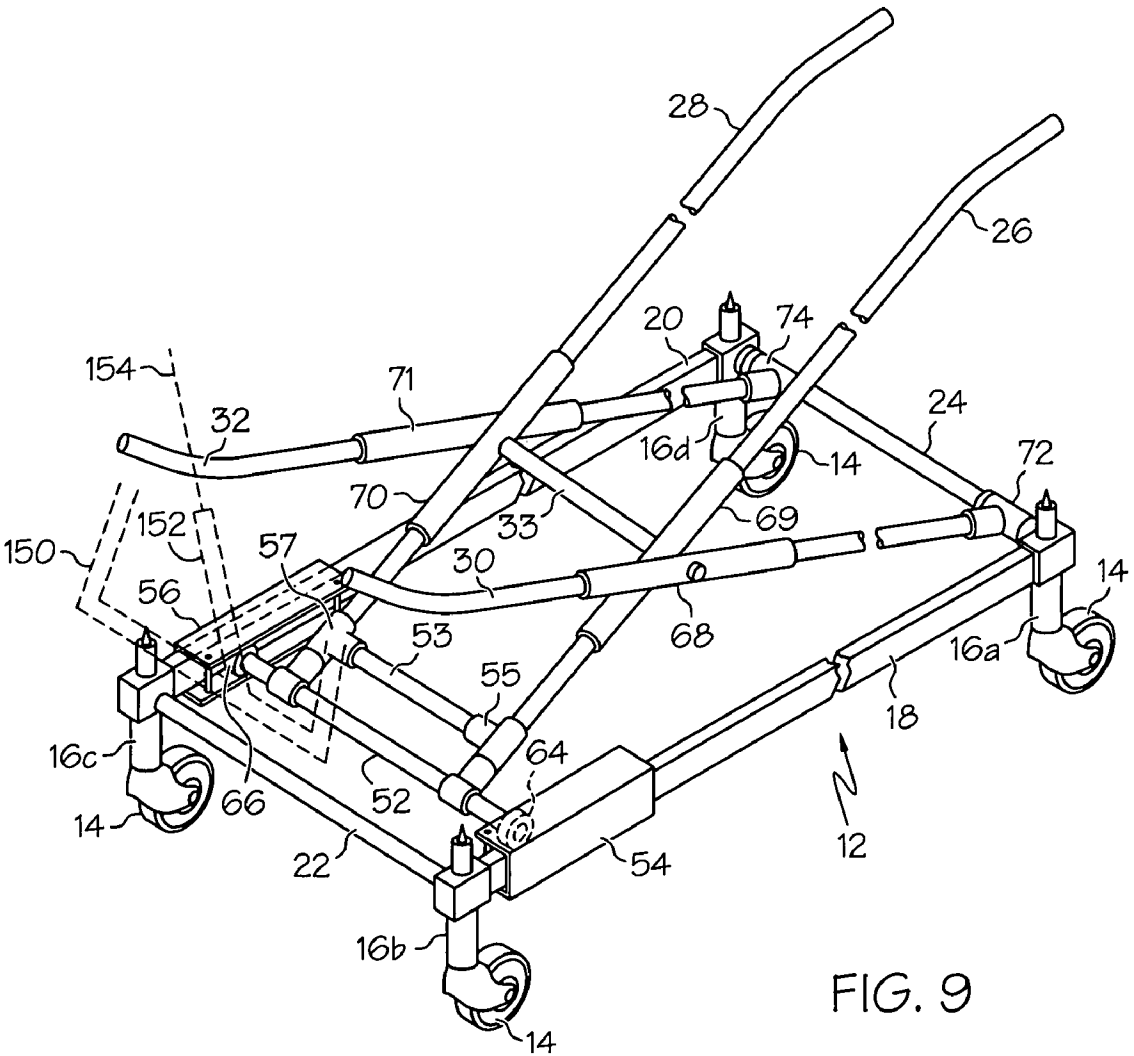
FIG. 9 is a perspective view of the undercarriage portion of the stretcher with the complementary prior art cross-forming frame members.

Referring first to FIGS. 1, 2 and 9, the stretcher 10 of the present invention is illustrated in both an elevated (FIG. 1) and fully down (FIG. 2) position. The stretcher 10 has a rectangular undercarriage 12 including a pair of opposing side frame members 18, 20 interconnected by a pair of transverse frame members 22, 24. For purposes of explanation, the undercarriage will be referred to as having a leading or front end and a trailing end, with the leading end being defined as the end toward the loading wheels 50 on the cot frame 34. Undercarriage 12 also includes downwardly extending supports 16*a*, 16*b*, 16*c* and 16*d* affixed as shown at respective corners of the rectangular undercarriage. Undercarriage wheels 14 are attached to the downwardly extending supports in a conventional manner to provide high ground clearance for the undercarriage. This high clearance is particularly useful for ambulances having high wheel wells along their floors which the undercarriage of the stretcher must clear as it is rolled into the ambulance.

Figure 3:
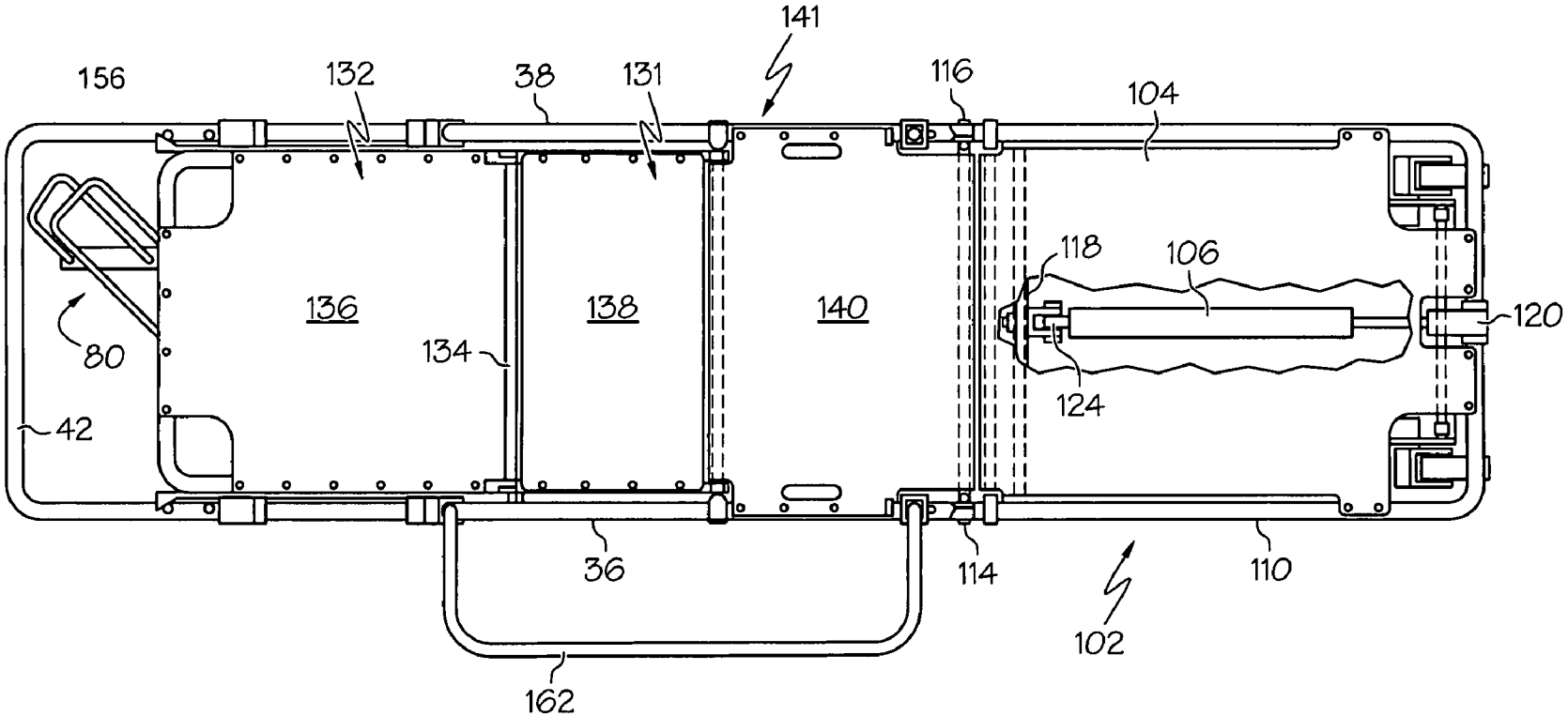
FIG. 3 is top plan view of the stretcher of FIG. 1, with certain parts broken away to show underlying parts.
Figure 4:
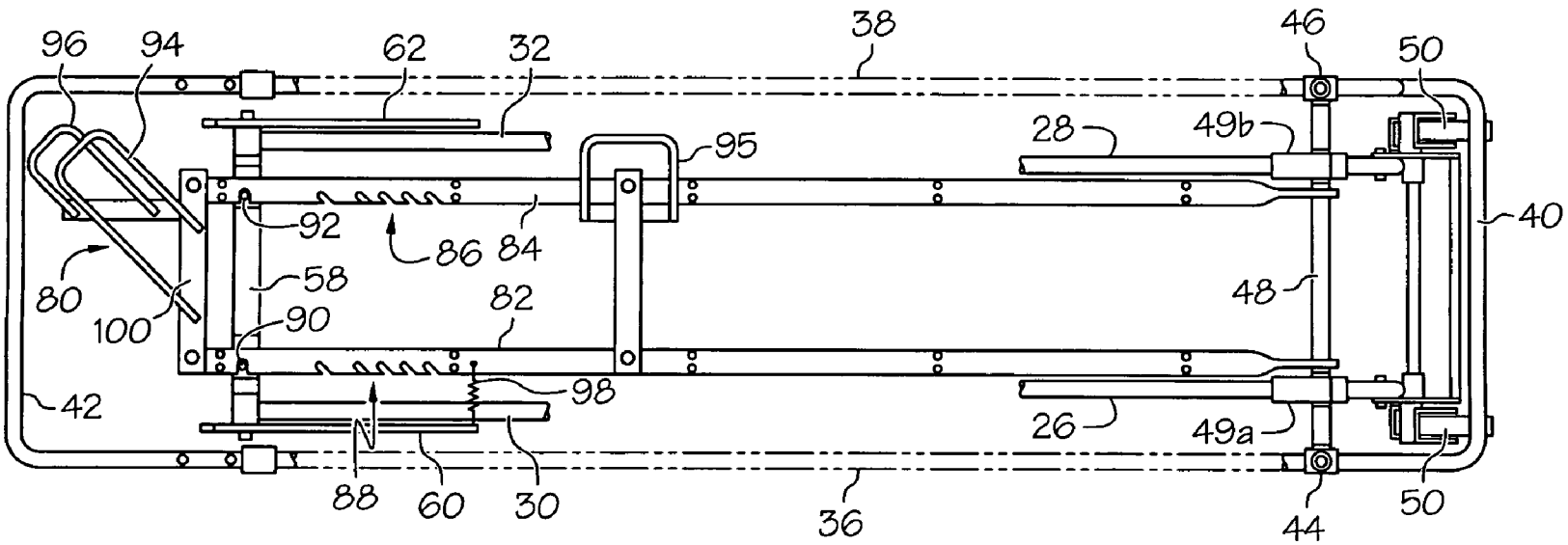
FIG. 4 is a top plan view of the latching mechanism of the stretcher, with certain parts removed for purposes of illustration.

Referring also now to FIGS. 3 and 4, the stretcher frame 34 also has a leading or front end and a trailing end, with the leading end again being defined as the end toward the load wheels 50. The stretcher frame 34 includes a pair of opposing tubular side frame members 36, 38 which are interconnected at their respective ends by tubular transverse frame members 40, 42, respectively. The leading end of frame 34 includes a pair of supports 44, 46 which extend downwardly from each of opposing side frame members 36, 38. The opposite ends of supports 44, 46 are secured to a transverse member 48 (also seen in FIGS. 4 and 5) which extends across and below the frame 34. A pair of load wheels 50 are secured to frame 34 through transverse member 48 by rotatable fittings 49*a* and 49*b*.

As best viewed in FIG. 9, extending upwardly from undercarriage 12 are coacting pairs of complementary cross-forming frame members 26, 28, 30 32 extending between and interconnecting frame 34 and the undercarriage 12. The frame members in each respective pair are pivotally connected together intermediate their opposite ends by a transverse bar 33 and associated fittings and sleeves 68, 69, 70 and 71. The frame members 26, 28, 30 and 32 are operative to position stretcher 10 in at least a first "down" position and a second "up" position. The up position, in which the frame members and the cot frame are elevated, is shown in FIG. 1. In the down position, the frame members are fully collapsed as illustrated in FIG. 2. When in the fully collapsed position, undercarriage wheels 14 and the pair of load wheels 50 support the weight of stretcher 10. This permits the stretcher to be used for upright seating for several patients and passengers in an ambulance.

As shown, the first frame members of each pair 26, 28 are connected at their lowermost ends to opposite sides of a cross piece 52. Additional bracing and support is provided by a second cross piece 53 secured to frame members 26, 28 through fittings 55, 57. Opposing ends of cross piece 52 include rotatable rubber bearings 64, 66 which are slidably mounted in brackets 54, 56. Brackets 54, 56 are secured to opposing side frame members 18, 20 of undercarriage 12 adjacent the trailing end of undercarriage 12. The second frame members of each pair 30, 32 are rotatably connected at their lowermost ends to transverse frame member 24 on the leading end of undercarriage 12. As shown, the rotatable connections include T-shaped fittings 72, 74.

As best seen in FIGS. 1 and 4, the uppermost ends of first frame members 26, 28 are rotatably connected to transverse frame member 48 on cot frame 34 adjacent the leading end thereof. The uppermost ends of the second frame members 30, 32 are rotatably connected to a transverse support member 58. Transverse support member 58 is slidably mounted in a pair of opposing brackets 60, 62 secured to stretcher frame 34.

Figure 5:
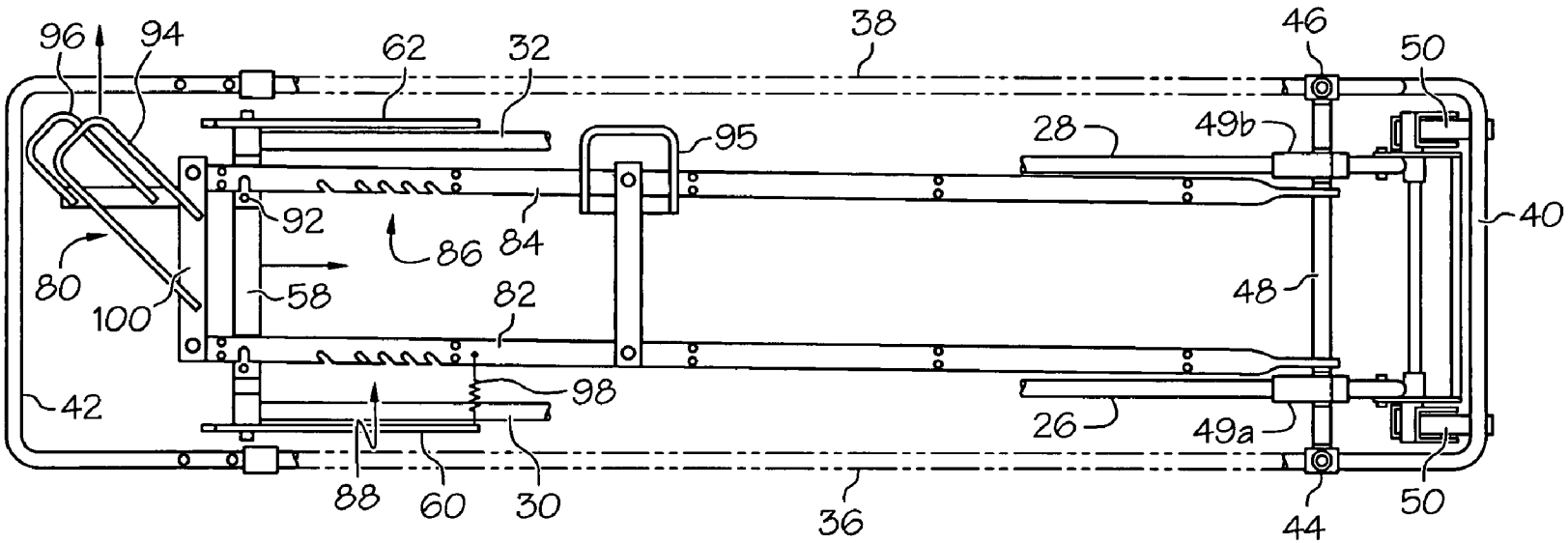
FIG. 5 is a top plan view of the latching mechanism of the stretcher showing the manner of releasing the mechanism, with certain parts removed for purposes of illustration.

Referring now to FIGS. 4 and 5, the stretcher 10 includes means for latching the pairs of frame members 26, 28, 30 and 32 in said at least two, and preferably several positions ranging from a first down, fully collapsed position to a fully elevated position. The latching means are generally indicted at 80 and comprise a pair of latching bars 82, 84 secured together by cross piece 100. Each of the latching bars are secured at respective first ends thereof to transverse member 48 on frame 34 and at respective second ends thereof to cross piece 100. Each of the latching bars 82, 84 includes a plurality of spaced apart slots, generally indicated at 86, 88. The slots are angled and adapted to engage a corresponding pair of load-bearing pins 90, 92 located on transverse support member 58.

As shown, pin engaging means, such as handles 94 and 96, are operatively connected to the latching bars by a cross piece 100. These handles may be manipulated by the emergency medical technician standing at the end of the stretcher by pulling them in the direction indicated by the arrow in FIG. 5 to disengage pins 90, 92 from individual slots. An additional handle 95 is provided on latching bar 84 so that the latching mechanism may also be operated from one side of stretcher 10.

Spring 98 biases latching bars 82, 84 to force slots 86, 88 to engage with pins 90, 92. The technician may select the position in which cot 10 is placed, from fully down to fully elevated by sliding the latching mechanism in the direction of the arrow in FIG. 5 and then releasing the handle(s) to reengage the slots with pins 90, 92. As slots 86, 88 are angled to seat with pins 90, 92, and transverse support member 58 is load bearing, the latching mechanism provides a positive lock of stretcher 10 into a desired position.

As an alternative or additional way of moving the frame members between the positions an hydraulic or pneumatic piston may extend from the lower frame to the upper frame or from the lower frame to the axis of the pairs of frame members. Such an arrangement is disclosed in GB 2 348 359A, the contents of which are hereby incorporated. In this way actuation of the piston or any other expandable or contractable member can effect the required lifting or lowering of the upper part of the stretcher. Power may be provided manually, for instance by a foot pedal or electronically from a battery on the stretcher.

Figure 6:
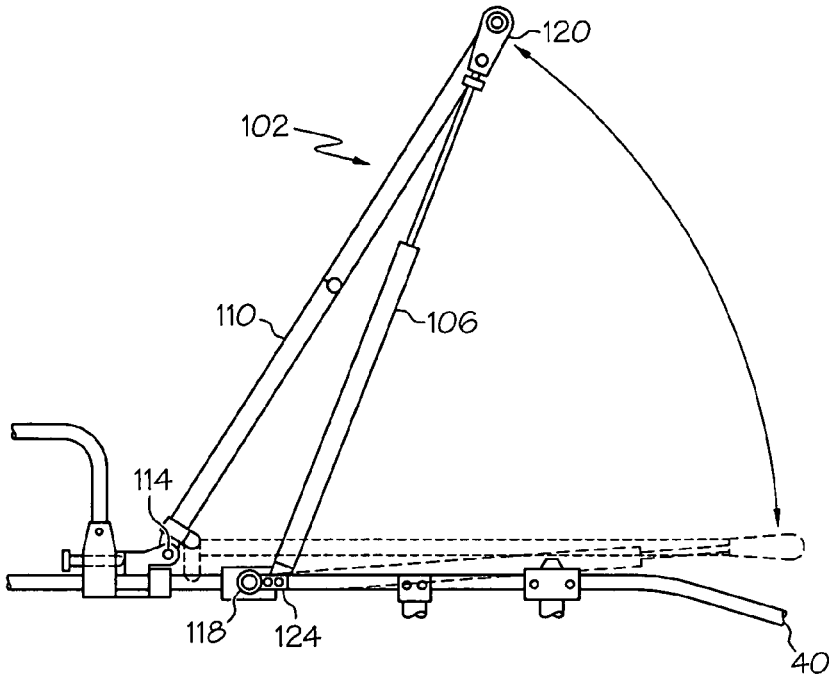
FIG. 6 is a partial side plan view illustrating the back support mechanism.
Figure 7:
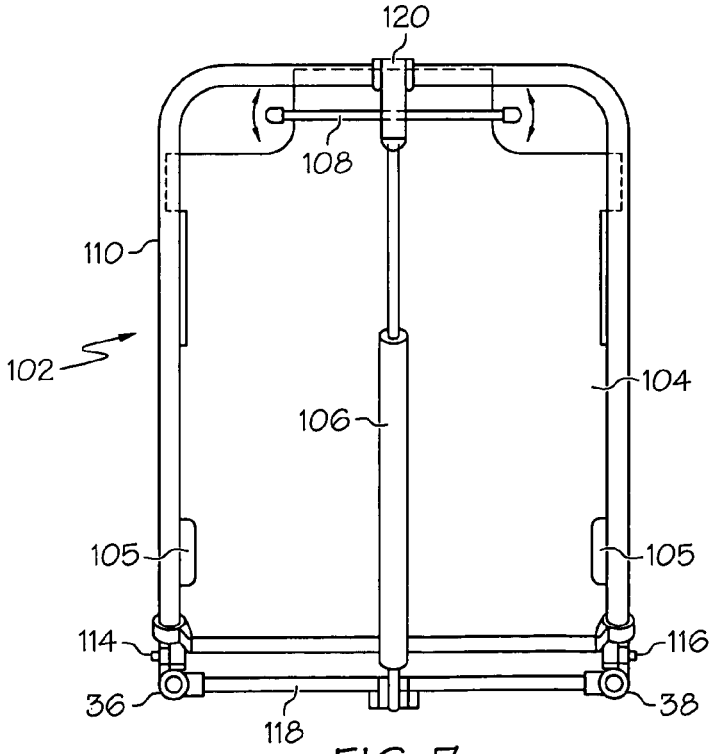
FIG. 7 is a partial end view illustrating a prior art back support mechanism.

The stretcher frame 34 also includes longitudinally extending foot, seat, and back support sections which may be positioned to provide support and comfort to a patient during transport. Referring now to FIGS. 1, 3, 6 and 7, back support section 102 includes a flat support plate 104 which is secured to continuous tubular member 110 by suitable means such as rivets or screws. Plate 104 includes several cut-out areas, such as those indicated at 105, to permit hand holds to be obtained on continuous tubular member 110 as needed. Back support section 102 also includes a gas-assisted cylinder 106 for raising the back support section from a first substantially horizontal position as shown in FIGS. 1 and 6 to a plurality of raised positions, such as the raised positions shown in FIG. 6 and in dotted lines in FIG. 1. Manipulation of bar 108 by the emergency technician in any of the directions shown by the arrows in FIG. 7 causes a raising or lowering of the back support as desired. That is, depressing or raising either end of bar 18 by a technician depresses a detent on cylinder 106 which released a locking mechanism internally in the cylinder and permits movement of back support section 102. When bar 108 is released, it moves back to a centered, at rest, position permitting the detent on cylinder 106 to raise and locking back support section 102 in place.

As shown, back support section 102 is pivotally connected to the side frame members 36, 38 of cot frame 34 by bifurcated hinges 114 and 116. The hinges are of a conventional construction in which a bifurcated part receives a tongue part, the parts being connected together by a pivot pin. The hinges 114 and 116 are oriented to permit back rest section 102 to be moved from and to the positions indicated in the drawing figures. Also as shown, cylinder 106 is rotatably secured to a transverse member 118 on cot frame 34 via hinge 124. At its opposite end, cylinder 106 is secured to continuous tubular member 110 via a hinged mounting 120 which swivels to accommodate the raising and lowering of back support section 102.

Figure 8:
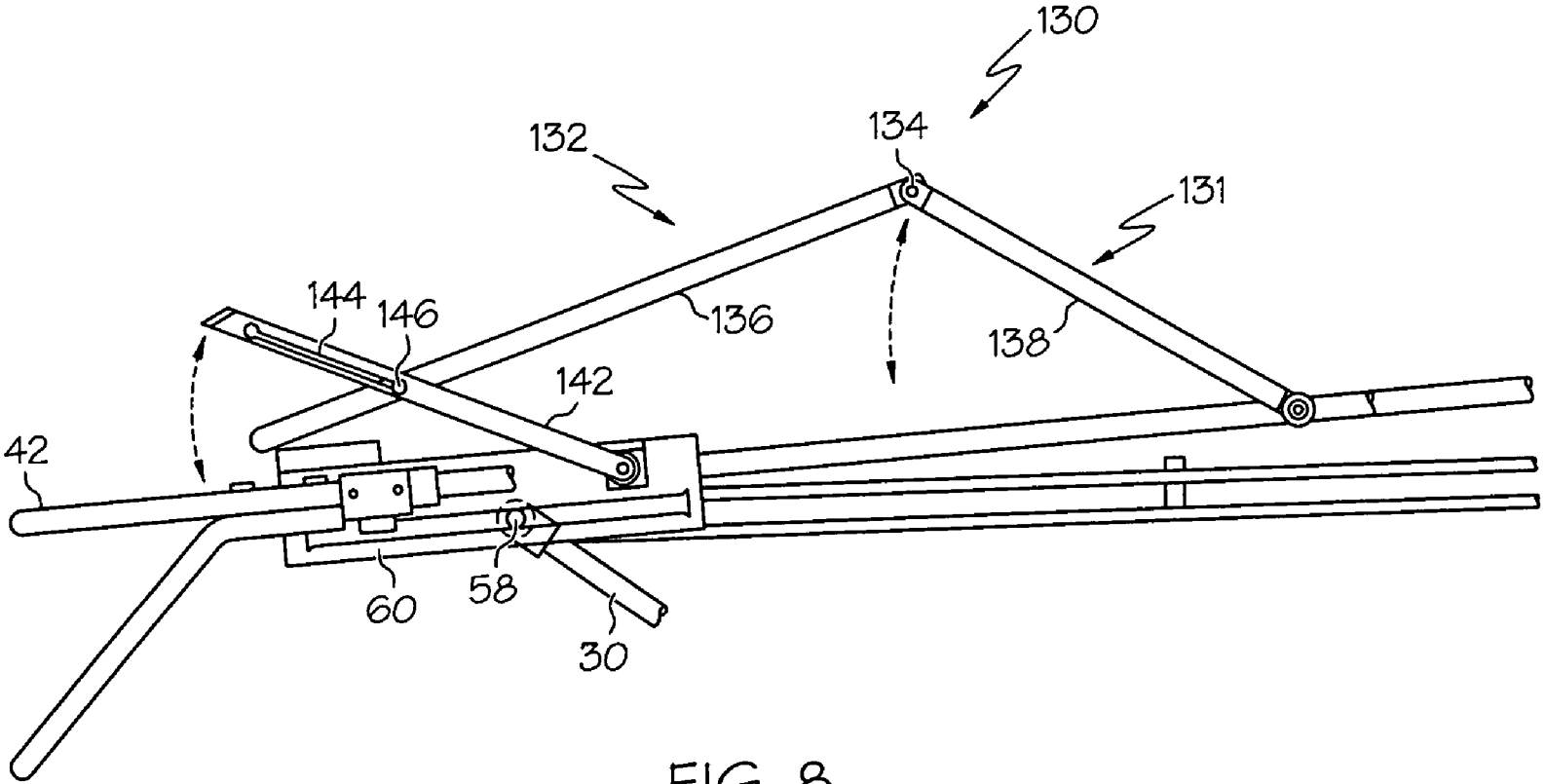
FIG. 8 is a partial side plan view illustrating a prior art adjustable dual position foot support mechanism.

Referring principally now to FIGS. 1, 3 and 8, the stretcher also includes an adjustable foot support section 130. Foot support section 130 includes first and second portions 131 and 132, respectively, which are pivotally connected along hinge 134. Those portions include flat plates 136, 138 for supporting a patient's legs. Together with seat plate 140, a complete patient support structure 141 is provided.

As shown, pivotally mounted arms 142 (corresponding structure on opposite side of stretcher not shown) have guide slots 144 which receives a pin 146 moveable to two different positions as desired. The guide slots include enlarged openings at both ends of the slots which latch the pins in place. In a first elevated position, shown in dotted lines in FIG. 1, pin 146 is locked in the end of guide slot 144 closest to the trailing end of cot 10. This causes both portions 136 and 138 to be raised to lift a patient's legs to a "shock" position as is known in the art.

This lifting motion has traditionally been effected by manual lifting. However the lifting is often in response to an emergency condition and thus must be effected rapidly. Consequently operatives may not have time to adjust themselves to the correct lifting position and may injure themselves. This problem is exacerbated when an overweight patient is on the trolley. Consequently a hydraulic or pneumatic or other automatic lifting device is provided.

As shown in FIGS. 1, 2, and 9 a u-shaped frame 150 is secured to and depends downwardly from the transverse frame member 42. A pneumatic or hydraulic cylinder 152 is pivotally mounted to the bottom cross member of the frame 150 and the piston 154 of that cylinder is pivotally connected to the midpoint of the end of the frame 156 that supports the flat plate 136. In the contracted position of the piston 154 and when the stretcher is in the lowered position shown in FIG. 2 the lower end of the frame 150 extends down through the lower frame, or down past the outside of the lower frame.

When raising the portions 136 and 138 to the shock position, in either the lower, upper or an intermediate position of the upper frame to the lower frame the piston and cylinder only pivot a modest amount. That is because of the mechanical advantage provided by the frame 150. The angle of the elongate extent of the cylinder to the vertical may be 30° or 20° or less prior to the piston being extended with that angle being arranged to decrease when raising the leg end for instance to 0° to the vertical.

Whilst the raising of the leg end has been described as being from a lower to an upper position, the position of the cylinder and piston enables positions between the limit positions to be effected. The leg end may be arrange to move through 15° or 20° or 25° or 30° or 40° when moving to the shock position.

The piston and cylinder may be activated by a power source on the trolley, in which case the operative can push a button on the trolley to raise the leg end and push another button to lower the leg end. Cessation of pushing the buttons can leave the leg end between the limit positions. Alternatively the raising and lowering of the leg end can be effected by an operative pushing a lever with their foot to pump up the end and releasing the lever to cause lowering of the foot end. Again intermediate positions can be arrived at by cessation of pushing and the leg end can be lowered by releasing the lever.

The stretcher also shows a way of supporting the knees and legs in a bent position. To achieve this the pin 146 may be caused to travel along the length of guide slot 144 to a position at the opposite end of the slot. Lifting of arm 142 when the pin is locked in this position causes the first and second portions 136 and 138 to form an inverted-v position which supports a patient's knees and legs in a bent position.

As shown in FIGS. 1-3, cot sides 160 and 162 are pivotally connected to each side frame member 36 and 38. In the raised position shown in FIG. 1 the sides 160 and 162 prevent a patient from rolling off the trolley or rolling over on the trolley by the mid portion of the patient abutting these sides. The cot sides can be locked in the raised position by a pin (not shown) on the sides cooperating with an opening in the frame member at one particular angular orientation. The cot sides 160 and 162 can be moved and locked in a horizontal position, when loading and unloading a patient, by releasing the pin by pushing lever 164, 165 to move the pin out of the opening against the bias of a spring. The sides are then pivoted to the horizontal as shown in FIG. 3 and the pin clicks back into a different opening in the frame to hold the sides in the horizontal position shown in FIG. 3. This is known technology.

Figure 10A:
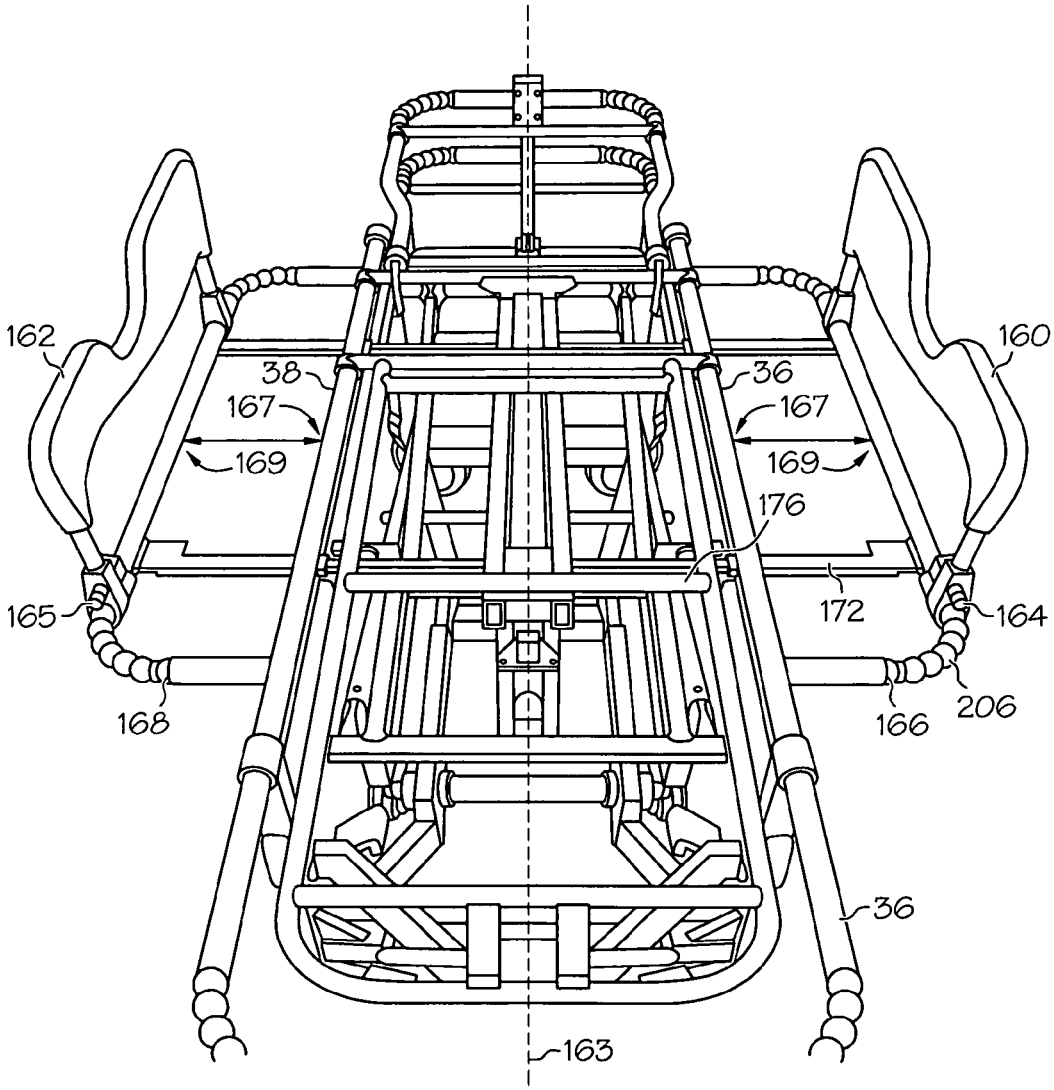
FIGS. 10A and 10B are each a schematic perspective view showing the cot sides in an extended position.
Figure 10B:
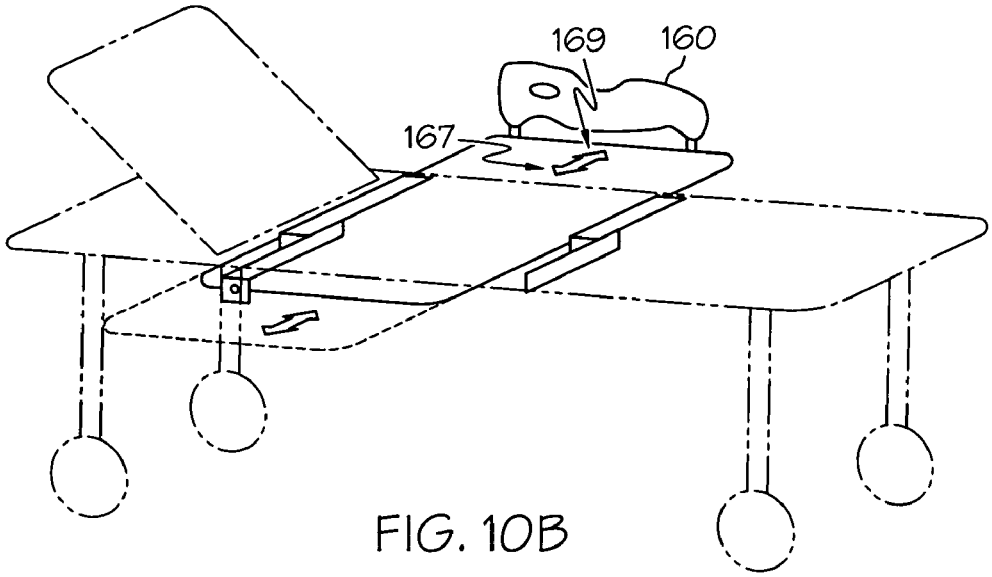

A modification to the trolley will now be described. If an overweight patient is to be loaded onto the trolley the cot sides can be moved outwardly to the position shown in FIGS. 10A and 10B. The cot sides 160 and 162 are each mounted on their own u-frame 166, 168 and can be pivoted on that frame between raised and horizontal positions as previously described. In the raised position of the cot sides in the extended position shown in FIG. 10A, an overweight patient can be supported by the trolley and prevented from falling off or rolling off the trolley by contact with the cot sides, albeit that a part of their body will overhang the upper main frame of the trolley at each side. The cot sides 160 and 162 can be adjusted to and held in various positions relative to a longitudinal center line 163 of the main upper frame of the stretcher 10, including the outermost position 169 furthest from the longitudinal center line 163 and an innermost position 167 in which the cot sides, in the raised position, are closest to the longitudinal center line 163 and abut the side frame members 36 and 38 and extends between these positions, as will now be described. As both cot sides move in the same way only cot side 160 will be described. As used herein, the innermost position 167 is also referred to as the first position and the outermost position 169 is also referred to as the second position and/or the extended position.

The frame 166 has spaced parallel rails 170 and 172 secured thereto adjacent to the pivot mountings of the cot side.

Figure 11:
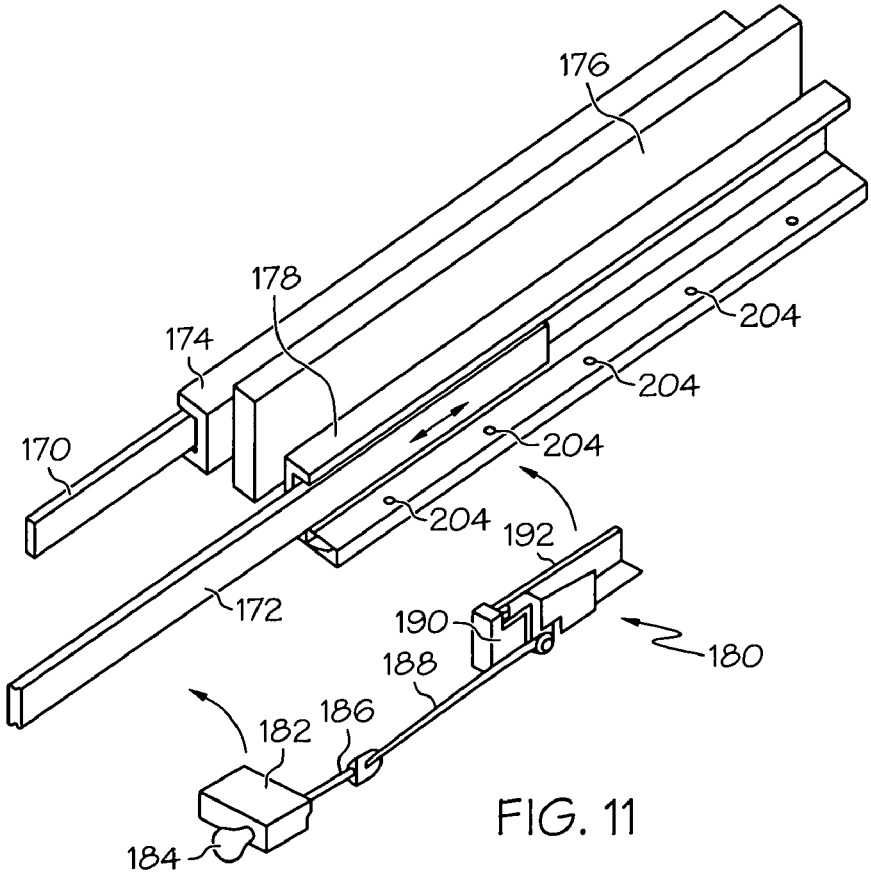
FIG. 11 is a schematic perspective view showing the sliding mechanism enabling movement of the cot sides.

The rail 170 slides in u-shaped cot guide 174 that is secured to a bracket 176 fast with the underside of the side frame members 36 and 38. The bracket 176 is shown in FIG. 11. It will be appreciated that the rail 170 from one cot side will be alongside the rail 172 from the other cot side. For ease of description though FIG. 11 shows the mounting brackets from one side being adjacent to each other. The u-shaped guide 174 has the open "u" facing away from the bracket 176 (and the other bracket 176). Thus the bracket 176 supports the rail 170 from beneath, and causes the rail 172 to slide in a linear horizontal direction towards and away from the side frame member 36.

The rail 172 similarly slides in a u-shaped guide 178. The open "u" of the guide 178 faces the other spaced bracket 176 and constrains the rail 172 to move linearly towards and away from the frame 36 or 38. In addition though the rail 172 and guide 178 include a releasable lock 180 that can fix the position of the cot sides at an outer, inner and at least one intermediate position.

The lock 180 includes a housing 182 secured to the outer end on the side of the rail 172. A knob 184 is located on the outer side of the housing 182. A shaft 186 extends from the knob through an opening in the housing and is connected to a cable 188 that is pivotally connected to a lever 190. The lever 190 is pivotally mounted on a block 192 that is fast with the innermost side of the rail 172.

Figure 12:
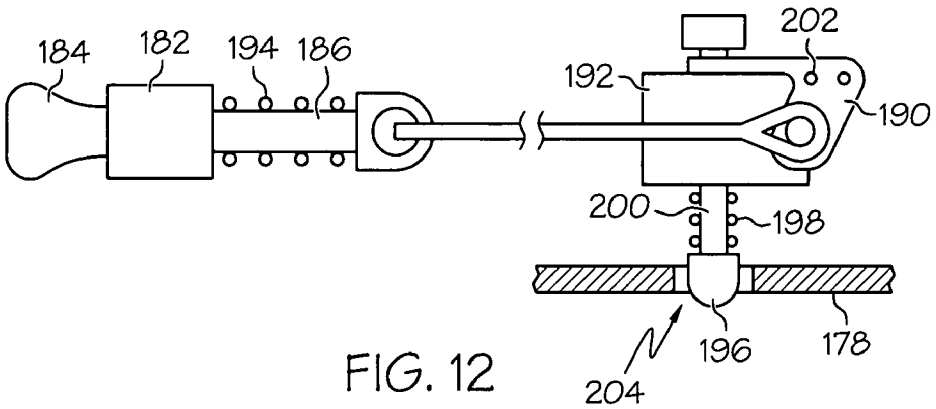
FIGS. 12 and 13 are side views showing the sliding mechanism in the locked and released position respectively.

In the position shown in FIG. 12, the knob 184 is biased against the housing 182 by a compression spring 194 surrounding the shaft 186 and bearing against the housing 182. A detent 196 that is reciprocally mounted in the block 192 is biased to the position shown by a compression spring 198. The detent is mounted on a shaft 200 that extends through the block 192 with the shaft extending through the block 192. The lever 190 surrounds the shaft 200.

When the knob 184 is pulled, the lever 190 moves clockwise about a pivot 202 on the block 192 to cause the lever to raise the detent 196 against the bias of the spring 198.

Figure 13:
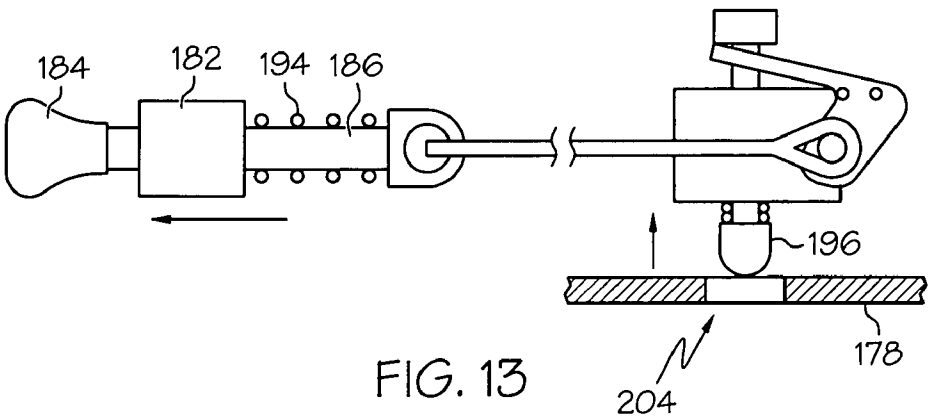

As shown in FIG. 13, when raised by the lever 190, the detent 196 assumes a release position 197 where it is clear of the area of a series of openings 204 formed along the extent of the guides 178. When the detent 196 is raised the cot side 160 can be moved in or out by pulling handles 206 forward on the frame 166. If desired, the knob can be released after the initial sliding movement of the cot side. The detent will then automatically snap into the next opening 204 along the guide 178 to assume a lock position 199, as shown in FIG. 12.

A variation in the method of moving and locking the cot sides 260, 262 in and out will now be described with reference to FIGS. 14-16. Both cot sides operate in the same way and so cot side 260 only will be described.

The cot side 260 includes a peripheral frame 261 when viewed in plan which, in normal use is largely located beneath the main support of the stretcher. Handles 263 project partially from the side of the main support. These allow the cot side to be moved between the position shown in FIG. 14A in solid lines to the position showing in phantom lines.

Towards each end of the cot side parallel rails 270, 272 are secured to opposite sides of the frame 261 and project inwardly towards the opposite side of the trolley. In both the inner and outer position of the cots sides these rails 270 and 272 lie partially alongside rails from the other cot side. The rails slide as previously described.

A locking mechanism 265 is constrained to slide with the cot sides and is secured to the inner member of the frame 261 at the mid point along its length. The locking mechanism 265 includes a plunger 267 that is biased by a spring 269 into one of a plurality of recesses 271 formed in a fixed cross member 273. Each cot side cooperates with the same cross member 273 and the center of the recesses 271 form a line along that member. Thus, depending on recess 271 that the plunger is located in, the cot side can be retained in one of a plurality of positions from the innermost to the outermost and at least one intermediate position.

The plunger can be released from the recess to allow sliding in or out movement of the cot side by a bar 274. The bar 274 is pivotally mounted to the mid point of the elongate members of the frame 261 by extending through and beyond loops 275 extending down from the elongate members. At the outside of the cot side the bar is bent downwardly and at right angles to the main extent of the bar to form a lever 276 located beneath the elongate member. At the inside of the cot side a housing 277 for the plunger is secured to the inner member of the frame 261. The inner end of the bar 274 extends upwardly and around a loop 279 of the housing 277 and then back on itself to cooperate with a plate 281 fast with the locking mechanism 265.

An operator can squeeze the lever 276 against the outer member of the frame with one hand to raise the locking mechanism 265 as a result of the pivotal movement of the bar 274. This movement releases the plunger 267 from the recess. At this time operator can slide the cot side in or out. With the lever 276 released the plunger will automatically lock the cot sides in the next detent.

The cot side members can, as before, be moved from a position on the outer frame member such that they can extend downwardly or upwardly from the frame member and the sides can be held in that position. Such a holding mechanism may comprise a spring biased plunger mounted on the frame being located in a detent in the cot side member.

As shown in FIG. 16, in which the cot side is in an outer position, the frame 261 can have a supplementary patient support 281, such as a sheet, fast therewith. The supplementary patient support 281 may be arranged to move with the cot side. In addition thereto, or in the alternative thereof, the supplementary patient support 281 may be arranged to slide from beneath the patient support 130 when moving the cot side from the first position 167 to the second position 169. When the cot side is in the outer position, a mattress side 283 can be loaded thereon. A plurality of mattress sides 283 may be provided of different widths in dependence upon the extent of projection of the cot side.

Trolleys as described are transported in ambulances. The ambulances have mountings provided on the floor towards one side of the ambulance. Such mountings are shown in U.S. Pat. No. 5,092,722 or EP 0 979 641, for instance, the contents of which are hereby incorporated. With the cot sides in an extended position the ambulance floor can be provided with two sets of such mountings (or any other mountings that restrain a stretcher in the ambulance). In this way the trolley can be located at the side when the cot sides are in the conventional inwards position, or away from the sides such as a central position when the cot sides are out.

Whilst the specific embodiments have been described in relation to a roll-in cot or stretcher it will be appreciated that the invention is equally applicable to other types of stretchers which may or may not be required to be transported by ambulance and which may or may not have an upper frame moveable towards or away from a lower frame.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A stretcher apparatus includes a patient support and a pair of cot sides extending to an elevation greater than the support, each of the cot sides extending at least partially along a different side of the support, each of the cot sides being moveable from a first position to a second position in which, in the second position, each of the cot sides is further from a longitudinal center line of the stretcher than the distance from the center line when in the first position, each of the cot sides having a rail connected thereto and constrained to move therewith from the first position to the second position, the rail of each cot side being supported to a different side of a bracket via a respective guide and arranged to extend at least partially under the patient support when in the first position, and being coextensive over at least part of their extent in at least one position of the cot side.

2. The stretcher apparatus as claimed in claim 1 including a supplementary patient support arranged to move with a respective cot side from the first position to the second position.

3. The stretcher apparatus as claimed in claim 2 wherein the supplementary patient support is arranged to slide from beneath the patient support when moving with the respective cot side from the first position to the second position.

4. The stretcher apparatus as claimed in claim 1 wherein the rail of each cot side is slidably supported by the respective guide.

5. The stretcher apparatus as claimed in claim 1 wherein the rail is a first rail and each of the cot sides includes a second rail spaced apart from the first rail.

6. The stretcher apparatus as claimed in claim 5 wherein the second rail of each cot side is constrained to move with the cot side from the first position to the second position.

7. The stretcher apparatus as claimed in claim 5 wherein the second rail of each cot side is arranged to extend at least partially under the patient support when in the first position.

8. The stretcher apparatus as claimed in claim 5 wherein the second rail of each cot side is slidably supported to a different side of a the bracket via the respective guide.

9. The stretcher apparatus as claimed in claim 5 wherein the second rail of each cot side is coextensive over at least part of their extent in at least one position of the cot side.

10. The stretcher apparatus as claimed in claim 1 further comprises a releasable lock to releasably fix a respective cot side in at least one position.

11. The stretcher apparatus as claimed in claim 10, wherein the releasable lock is located beneath the patient support and comprises a detent operable between a release position and a lock position by a lever, said detent releasably fixes a respective cot side in at least one position.

12. The stretcher apparatus as claimed in claim 11 wherein the lever is located to a side of the patient support.

13. The stretcher apparatus as claimed in claim 11 wherein the lever is arranged to move with the respective cot side from the first position to the second position.

14. The stretcher apparatus as claimed in claim 1 in which at least one cot side is movable from a first configuration in which the cot side extends to an elevation greater than the patient support to a second configuration in which the cot side is at a lower elevation relative to the patient support.

15. A method of transporting a patient in excess of a predetermined factor comprising:

providing a stretcher apparatus which includes a patient support and a pair of cot sides extending to an elevation greater than the support, each of the cot sides extending at least partially along a different side of the support, each of the cot sides being moveable from a first position to a second position in which, in the second position, each of the cot sides is further from a longitudinal center line of the stretcher than the distance from the center line when in the first position, each of the cot sides having a rail connected thereto and constrained to move therewith from the first position to the second position, the rail of each cot side being supported to a different side of a bracket via a respective guide and arranged to extend at least partially under the patient support when in the first position, and being coextensive over at least part of their extent in at least one position of the cot side;

moving at least one cot side away from the longitudinal center line of the support when the patient is in excess of the predetermined factor; and supporting the patient on the patient support.

16. The method as claimed in claim 15 further comprises providing a supplementary patient side support when a cot side is moved to the second position.

* * * * *

UNITED STATES PATENT AND TRADEMARK OFFICE

CERTIFICATE OF CORRECTION

PATENT NO. : 7,676,861 B2
APPLICATION NO. : 11/474602
DATED : March 16, 2010
INVENTOR(S) : Philip Ward et al.

It is certified that error appears in the above-identified patent and that said Letters Patent is hereby corrected as shown below:

Title Page, Item (57) Abstract, "end of the unshaped frame" should read as -- end of the u-shaped frame --

Signed and Sealed this

Twelfth Day of October, 2010

David J. Kappos

David J. Kappos
*Director of the United States Patent and Trademark Office*